US007036408B2

(12) United States Patent
Savoie et al.

(10) Patent No.: US 7,036,408 B2
(45) Date of Patent: May 2, 2006

(54) LENSLATHE WITH VIBRATION CANCELLING ARRANGEMENT

(75) Inventors: Marc Y. Savoie, Moncton (CA); Edward McPherson, Moncton (CA)

(73) Assignee: Satisloh GmbH, Wetzlar (DE)

( * ) Notice: Subject to any disclaimer, the term of this patent is extended or adjusted under 35 U.S.C. 154(b) by 419 days.

(21) Appl. No.: 10/332,726

(22) PCT Filed: Jul. 11, 2001

(86) PCT No.: PCT/CA01/01012

§ 371 (c)(1),
(2), (4) Date: Jun. 3, 2003

(87) PCT Pub. No.: WO02/06005

PCT Pub. Date: Jan. 24, 2002

(65) Prior Publication Data

US 2003/0183050 A1 Oct. 2, 2003

(30) Foreign Application Priority Data

Jul. 13, 2000 (CA) ..... 2313830

(51) Int. Cl.
*B23B 1/00* (2006.01)

(52) U.S. Cl. ..... 82/1.11; 82/1.3; 82/11.3; 82/118

(58) Field of Classification Search ..... 82/1.11, 82/1.4, 11.3, 118, 133, 138; 451/152, 134, 451/14, 149

See application file for complete search history.

(56) References Cited

U.S. PATENT DOCUMENTS

| | | | | |
|---|---|---|---|---|
| 5,195,407 | A * | 3/1993 | Takeno et al. | 82/1.11 |
| 5,320,006 | A * | 6/1994 | Blocha et al. | 82/1.11 |
| 5,430,504 | A * | 7/1995 | Muckenhirn et al. | 351/161 |
| 6,122,999 | A * | 9/2000 | Durazo et al. | 82/1.11 |
| 6,523,443 | B1 * | 2/2003 | Hof et al. | 82/1.4 |

* cited by examiner

*Primary Examiner*—Willmon Fridie, Jr.
(74) *Attorney, Agent, or Firm*—Volpe and Koenig, P.C.

(57) ABSTRACT

A method and apparatus for substantially nullifying vibration and deflection in a single point lens turning lathe having a rapidly reciprocating lens cutting tool and shuttle assembly. The apparatus includes three or more tool shuttles of similar mass mounted for reciprocating movement along respective generally parallel shuttle paths. The shuttles are reciprocally moveable by respective actuators along their respective shuttle paths. The shuttle and tool assemblies are moved by their respective actuators in opposite directions at a rate which causes forces generated by shuttle and tool assemblies moving in one direction to cancel forces arising from the shuttle and tool assembly movement in the opposite direction. Should an odd number of shuttle and tool assemblies be used, the amount of force generated by the mass moving in one direction may be compensated by having a different rate of movement, and hence a different stroke length from the mass moving in the opposite direction.

19 Claims, 8 Drawing Sheets

LENSLATHE WITH VIBRATION CANCELLING ARRANGEMENT

FIELD OF THE INVENTION

This invention relates generally to apparatus and methods for cutting lenses and more particularly to turning lathes for cutting non-rotationally symmetrical lenses.

BACKGROUND OF THE INVENTION

An efficient way to produce rotationally asymmetrical surfaces is with a three-axis single point diamond turning lathe. FIG. 1 is an end elevation showing a typical layout for such a lathe and FIG. 2 is a front elevation corresponding to FIG. 1. The lathe which is generally indicated by reference 10 includes a lens supporting assembly 20 and a shuttle 14. The shuttle 14 is axially movable along a "Z axis" indicated by reference Z by an actuator 16. A lens cutting tool 18 (typically a diamond tool) is secured to the shuttle 14.

The lens supporting assembly 20 supports a lens 22 and rotates the lens 22 about a lens axis indicated by θ. The lens supporting assembly 20 is moveable in a direction Y transverse to the lens axis θ. The lens supporting member typically includes a spindle 21 which rotates the lens 20. The spindle 21 is mounted to a transversely moveable linear table 23 which in turn is mounted to a base 25 of the lathe 10.

Lens cutting is effected by a turning operation. The lens 22 is rotated at a high speed about the lens axis θ. The lens cutting tool 18 is initially placed adjacent an edge 24 of the lens 22. The lens 22 is moved in the direction Y as the lens cutting tool 18 is moved in the direction Z. Coordinated movement between the lens 22 and the lens cutting tool 18 determines the shape of the lens 22.

If the lens 22 is rotationally symmetrical, such as spherical or aspherical, the lathe 10 is operated similarly to a two axis turning lathe. The cut typically starts at the edge 24 and the lens cutting tool is moved both in the Y and Z directions (radially inwardly and toward the lens 22). In this instance, the Z position of the lens cutting tool 18 remains constant at any given radial ("Y") distance from the lens axis θ regardless of rotation about the lens axis θ.

The relative speed between the lens cutting tool 18 and the respective surface of the lens being cut diminishes to zero as the lens cutting tool 18 approaches the lens axis θ. Accordingly, a very high spindle speed in the lens supporting assembly 20 is desirable in order to maintain an acceptable and productive surfacing operation. Typical spindle speeds are on the order of 3,000 to 10,000 RPM.

When the desired lens is non-rotationally symmetrical, as for example in the case of toric or progressive lenses, the lens cutting tool 18 must move reciprocally along the Z axis at a frequency proportional to the rotational frequency. Depending on the particular lens 22 being cut, the lens cutting tool 18 may need to be moved by as much as 20 mm at the edge of the lens. In a simple toric lens this would be a substantially sinusoidal motion with a frequency twice that of the rotational frequency.

A typical actuator 16 would consist of a linear servo motor (such as a voice coil motor) in conjunction with a high speed feedback device which is desirable as being able to produce high speed linear movement at great accuracy. Although such a motor typically has only limited travel, a typical stroke being 30 mm, it may nevertheless be required to achieve velocities as high as 3 to 4 m/s. Such velocities and rapid directional changes can create peak accelerations of 50 to 100 g or even higher. By way of example, if the shuttle 14 and lens cutting tool 18 have a total mass of 2 kg, an actuator acceleration of 100 g will develop reaction forces of 1961 N (approximately 440 lbs).

It will be appreciated that the above velocity and speed figures are somewhat high for currently available linear servo motors. Such technology is rapidly evolving and to some extent the current invention takes into account desired linear servo motor properties. In any case, the present invention produces a useful result with current linear servo motor technology capable of velocities and forces of about half those set out above.

The positioning of the lens cutting tool 18 along its tool path needs to be servo controlled to a very high degree of accuracy, typically within 10 nm or less. Assuming that the actuator 16 is capable of such accuracy, the magnitude of the actuating forces could cause structural defections in the lathe 10 which in themselves exceed the accuracy requirements.

It is an object of the present invention to provide a method and apparatus to cancel vibration caused by actuator forces in a lathe having a reciprocally moveable tool guidance assembly.

SUMMARY OF THE INVENTION

A tool guidance assembly is provided for a lathe. The tool guidance assembly has at least one first shuttle for mounting the tool and a first actuator for causing reciprocal movement of the first shuttle along a first shuttle path. The first shuttle and tool comprise at least part of a first reciprocating mass. The tool guidance assembly has a second reciprocating mass and a second actuator for moving the second reciprocating mass in a direction opposite to the first reciprocating mass. The second reciprocating mass has a mass, a path of movement and a rate of movement selected to substantially cancel accelerative forces caused by the reciprocating movement of the first reciprocating mass.

The second reciprocating mass may include a pair of second shuttles, each of the pair of second shuttles being disposed on opposite sides of the first shuttle. The second actuator may include respective actuators for each of the second shuttles.

The first reciprocating mass may also include a plurality of first shuttles and the first actuator may include a respective actuator for each of the first shuttles.

In one aspect of the invention, a single point diamond turning lathe is provided which has a first shuttle for supporting a cutting tool, the first shuttle being reciprocally moveable along a first shuttle path. A first actuator is connected to the first shuttle for effecting the reciprocal movement of the first shuttle. The lathe has a second shuttle adjacent the first shuttle for supporting a second cutting tool. The second shuttle is reciprocally moveable along a second shuttle path generally parallel to the first shuttle path. The second shuttle has a mass similar to that of the first shuttle. A second actuator is connected to the second shuttle for effecting reciprocal movement of the second shuttle in a direction opposite to that of the first shuttle by an amount of about half that of the reciprocal movement of the first shuttle. The lathe has a third shuttle adjacent the first shuttle opposite the second shuttle for supporting a third cutting tool. The third shuttle is reciprocally moveable along a third shuttle path generally parallel to and coplanar with the first and second shuttle paths, the third shuttle has a mass similar to that of the first shuffle. A third actuator is connected to the third shuttle for effecting reciprocal movement of the third shuttle in a direction opposite to that of the first shuttle by an amount of about half that of the reciprocal movement of the first shuttle. The second and third shuttle balance accelerative forces of the first shuttle to substantially cancel vibration and corresponding structural deflections imparted to the lathe by the reciprocal movement of the first shuttle.

According to a further aspect of the present invention, a lens cutting lathe is provided which includes a base having a lens support mounted to the base for supporting the lens and spinning the lens about a lens rotational axis. The lens support is transversely moveable relative to the lens rotational axis. A plurality of shuttles for mounting respective cutting tools are mounted to the base for movement along respective shuttle paths toward and away from the lens. The plurality of shuttles are reciprocally moveable by respective actuators mounted to the base. The actuators are arranged to move some of the plurality of shuffles in a direction opposite to a remainder of the plurality of shuttles. The plurality of shuffles are of similar mass and disposed and moved in a manner to maintain a generally fixed center of mass whereby movement of the shuttles in a given direction substantially cancels both linear and rocking forces imposed on said base by movement of the remainder of the shuttles in the opposite direction.

The plurality of shuttles may consist of two outer shuttles and an intermediate shuttle therebetween. The outer shuttles are arranged to move together in a direction opposite to the intermediate shuttle, and the outer shuttles move at a rate of about one half that of the intermediate shuttle. Accordingly, the total accelerative forces generated by the outer shuttles is generally the same as that generated by the intermediate shuttle.

According to another aspect of the present invention, the plurality of shuttles may consist of a row of four shuttles arranged in two pairs on either side of a central axis, the shuttles of each of the two pairs being arranged to move in opposite relative directions.

The actuator in the above embodiments may be a linear servo-motor.

Alternatively, the actuator may be a rotary servo-motor.

A method is also provided for nullifying accelerative forces induced in a lathe by movement of a cutting tool secured to a lathe shuttle mounted for reciprocal movement relative to a base of the lathe along a shuttle path. The method comprises the steps of:

i) providing a balancing mass having a center of mass along the shuttle path; and, ii) reciprocally moving the balancing mass in a direction and at a rate which cancels linear forces arising from the movement of the tool without imparting a corresponding rocking force to the structure.

According to one aspect of the method, the balancing mass may consist of at least two further cutting tools secured to respective shuttles mounted to the base for reciprocal movement by respective actuators along respective generally parallel shuttle paths.

A method is provided for turning a non-rotationally symmetrical lens on a lens turning lathe having a lens support and at least three cutting tools. The method comprises the steps of:

i) mounting a lens blank to a lens support assembly;

ii) rotating the lens blank with the lens support assembly about a lens rotational axis;

iii) pressing one of the at least three cutting tools against the lens blank;

iv) moving the lens blank with the lens support assembly in a direction transverse to the lens rotational axis;

v) reciprocally moving the above one of the at least three lens cutting tools relative to the lens along a first tool path at a reciprocal frequency corresponding to the rotational frequency of the lens blank to produce the non-rotationally symmetrical surface;

vi) reciprocally moving remaining of the at least three lens cutting tools along respective tool paths generally parallel to and coplanar with the first tool path of the one lens cutting tool in (v) at a reciprocal frequency, in a direction and at a rate which counters and substantially nullifies linear forces imposed on the lathe by the one tool in step v) without imparting a rocking movement on the lathe.

According to yet another aspect of the method for turning a non-rotationally symmetrical lens, the three lens cutting tools may consist of a first and a last lens cutting tool with an intermediate lens cutting tool disposed equidistantly therebetween and in line therewith. The first and last lens cutting tools are moved in unison contra to the intermediate lens cutting tool at a rate of about half that of the intermediate lens cutting tool.

The lens may be turned in three stages with a different of the three lens cutting tools utilized in each stage.

In an alternative embodiment, first, second, third and fourth lens cutting tools may be provided and arranged in line. The first and second cutting tools are moved contra to each other at a similar rate, and the third and fourth cutting tools are also moved contra to each other at a similar rate. The action of the third and fourth tools is rotationally contra to the first and second tools thus simultaneously cancelling any rotational vibration (rocking action).

The method may be further improved by including the further steps of:

vii) measuring any resultant imbalance force on the lathe associated with reciprocal movement of the lens cutting tools and generating an output signal;

viii) sending the output signal to a processor;

ix) determining how the force may be nullified by varying operation of the actuators;

x) sending an output to a controller which controls the reciprocal movement of the actuators to cause the controller to vary the movement of the actuators in response to the determination in step (ix) to substantially eliminate the resultant imbalance forces; and, xi) repeating steps vi) through x)

DESCRIPTION OF THE DRAWINGS

Preferred embodiments of the invention are described below with reference to the accompanying drawings in which.

DESCRIPTION OF PREFERRED EMBODIMENTS

According to the present invention, accelerative forces arising from reciprocating movement produced by a first mass, which may include one or more shuttles is cancelled by providing a second mass and moving the second mass in a reciprocating movement contra to the reciprocating movement of the first mass. The location and rate of movement of the second mass is selected to create a "balancing" or "cancelling" force opposite to and similar is magnitude to the accelerative forces produced by the first mass. The force created by the second mass should coincide with that produced by the first mass to avoid any undesirable "rocking" motion as a result of the cancelling forces. Although the second mass may simply be present for balancing proposes, as described in more detail below, the second mass is preferably made up of two or more shuttle and lens cutting tool assemblies which may be used as part of the lens cutting operation. Similarly, the first mass preferably consists of one or more shuttle and lens cutting tool assemblies.

The term "reciprocating" is used herein to refer to a back and forth motion which may, depending on the embodiment of the present invention being described, be either linear or arcuate.

Figure 3:
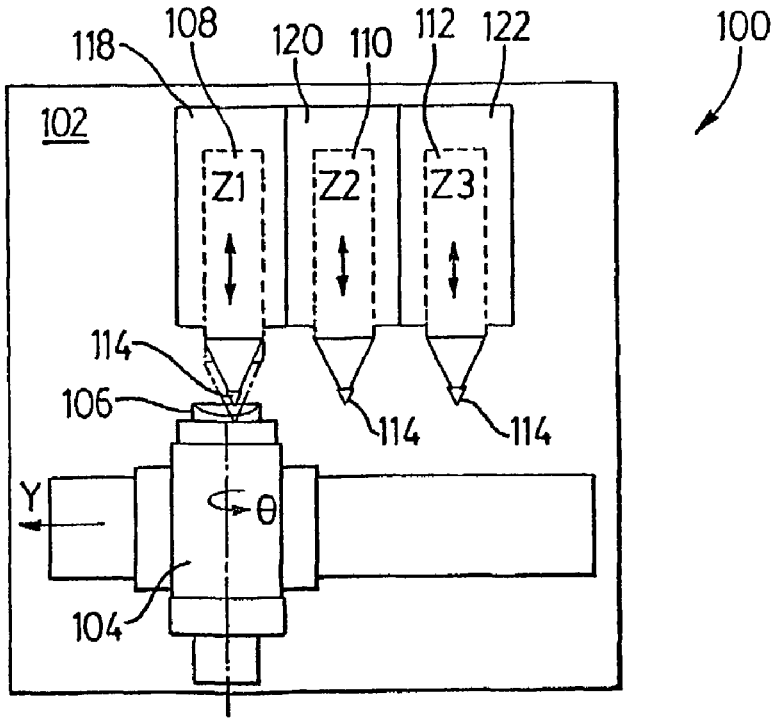
FIG. 3 is a front elevation illustrating a three shuttle lens cutting lathe.

FIG. 3 illustrates a lens cutting lathe 100 according to one preferred aspect of the present invention. The lens cutting lathe 100 includes a base 102 mounted to which is a lens support 104 which supports a lens 106 and is capable of spinning the lens 106 about a lens rotational axis θ. The lens support is transversely moveable relative to the lens rotational axis θ as indicated by reference Y.

Figure 1:
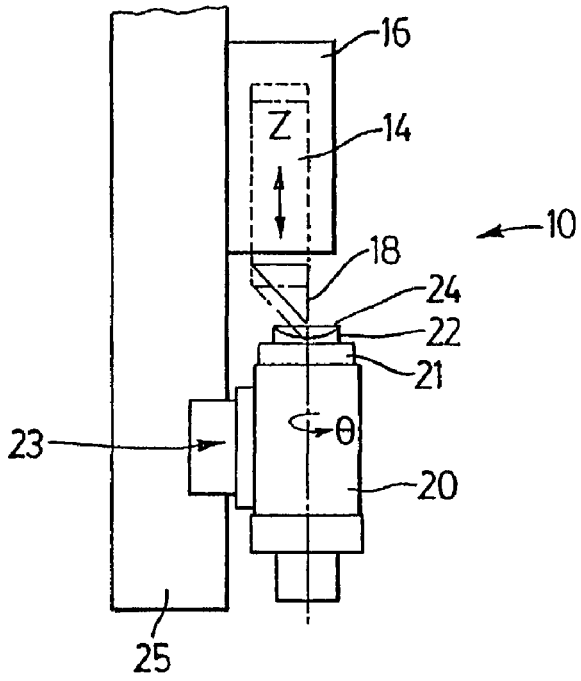
FIG. 1 (PRIOR ART)
FIG. 1 is an end elevation of illustrating a typical layout for a prior art single point diamond turning lathe.
Figure 2:
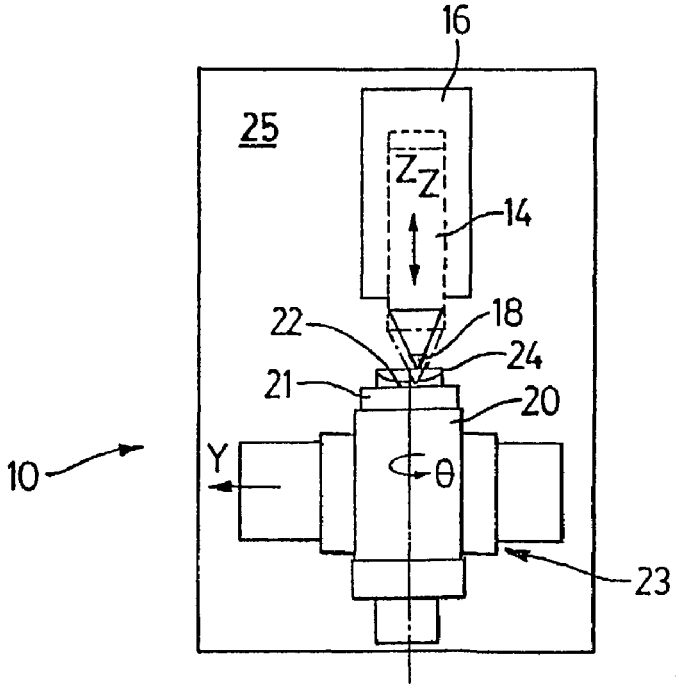
FIG. 2 (PRIOR ART)
FIG. 2 is a front elevation corresponding to FIG. 1.
Figure 4:
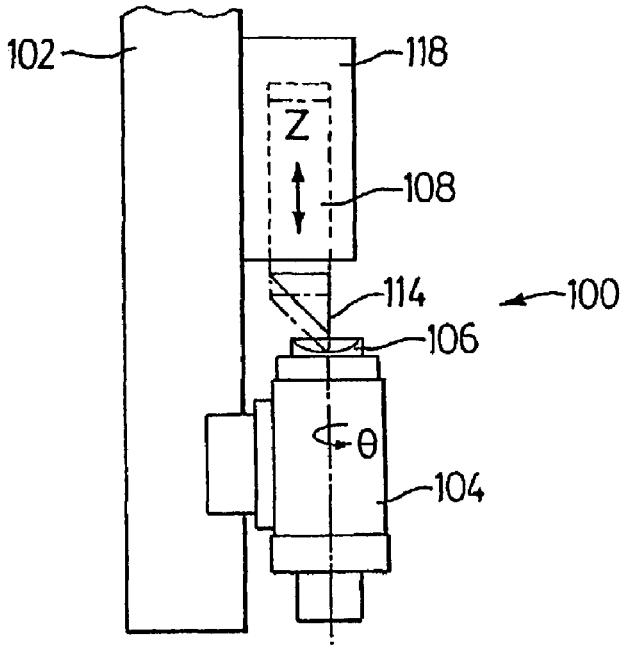
FIG. 4 is an end elevation corresponding to FIG. 3.

Three shuttles are mounted to the base 102 according to the FIGS. 3 and 4 embodiment. These comprise two outer shuttles 108 and 112 an intermediate shuttle 110 therebetween. Respective lens cutting tools 114 are mounted to the three shuttles 108, 110 and 112. The lens cutting tools 114 may be diamond tools of the type currently used for lens cutting.

The shuttles 108, 110 and 112 are reciprocally moveable by respective actuators 118, 120, 122 along respective shuttle axes or "paths" as indicated by references Z1, Z2 and Z3. Although the shuttle axes or paths Z1, Z2 and Z3 are shown as generally parallel to the lens rotational axis θ, this is not a requirement and it may be preferable for the shuttle axes Z1, Z2 and Z3 to be inclined relative to the lens rotational axis θ. The shuttle axes Z1, Z2 and Z3 should be parallel to each other. The actuators 118 and 122 are arranged to move the outer shuttles 108 and 112 in a direction opposite to the intermediate shuffle 110 at a rate half that of the intermediate shuttle 110. The respective masses of each of the outer shuttles 108 and 112 would typically be generally the same as that of the intermediate shuttle 110. The lens cutting tools 114 would also be of similar mass.

Figure 7:
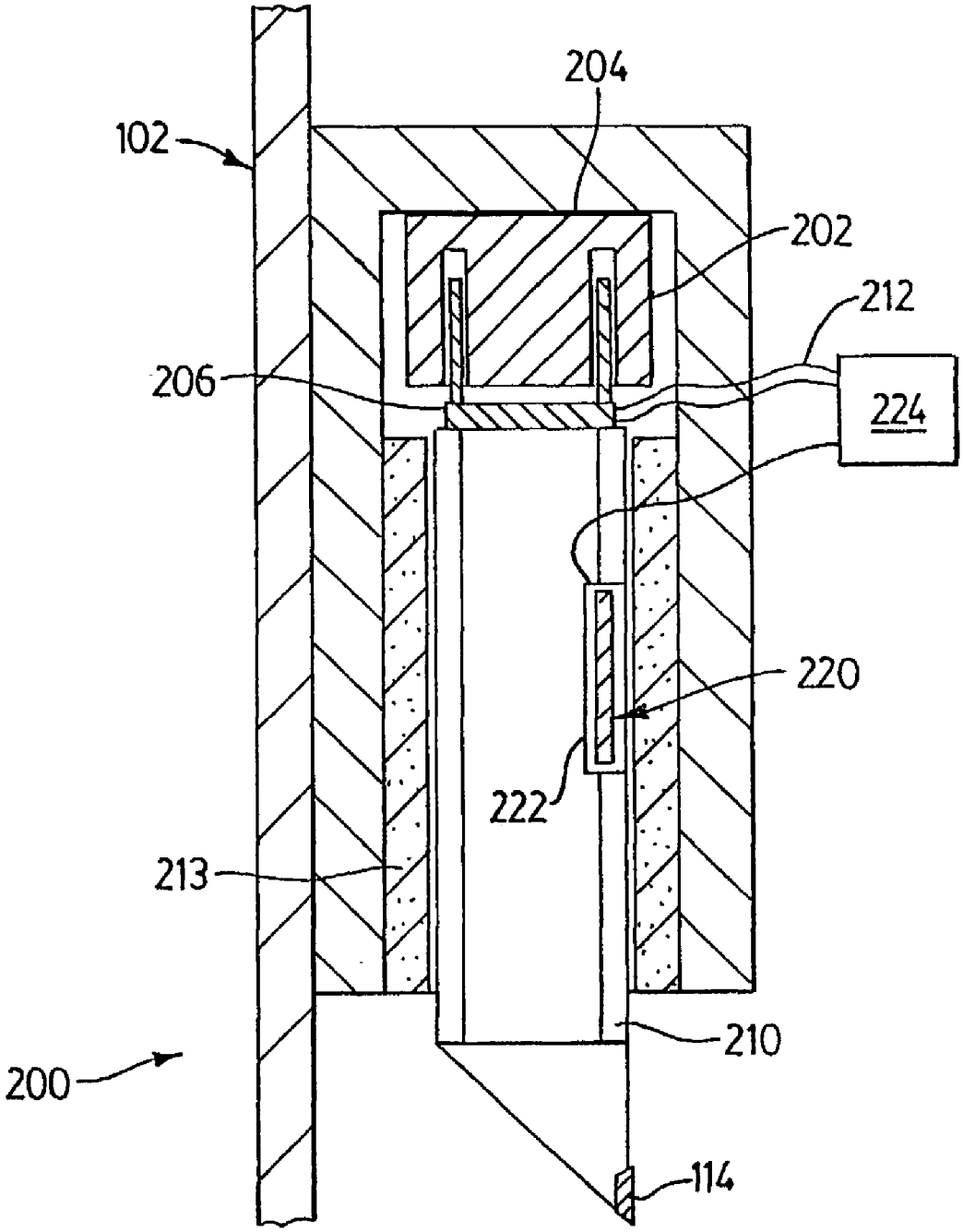
FIG. 7 is a longitudinal section through a typical actuator/shuttle assembly.

FIG. 7 illustrates a typical shuttle and actuator assembly 200. The shuttle and actuator assembly 200 includes a linear servo motor 202 which includes a magnet assembly 204 and a coil 206. The magnet assembly 204 is attached to a housing 208. The coil 206 is secured to a shuttle 210. Coil wires 212 provide electrical input to the coil 206 to cause relative movement between the coil 206 and the magnet assembly 204.

The shuttle 210 is mounted to the housing 208 for linear movement. Various mounting arrangements may be utilized. A currently preferred mounting arrangement is to use air bearing pads 212 between the housing 208 and the shuttle 210 to allow for smooth, accurate linear motion.

A position encoder 220 is secured to the shuttle 210. The position encoder may be a diffraction scale readable by a read head 222 secured to the housing 208 to provide position information to a high speed feedback device 224 which senses the position of the shuttle 210 and provides input to the coil 206 to vary the position of the shuttle 210 in accordance with a pre-determined position stored in a database 226.

Force is determined by the following relationship:

$$F=m\cdot a$$

where F=force m=mass a=acceleration

Assuming each of the shuttles 108, 110 and 112 has a mass $m_s$, and the intermediate shuttle 110 is accelerated and decelerated by an amount $a_i$, the accelerative forces $F_i$ associated with the intermediate shuttle 110 may be defined as:

$$F_i=m_s\cdot a_i$$

The outer shuttles 108 and 112 together have a combined mass of 2 $m_s$ (the "second mass"). As the outer shuffles 108 and 112 are moved at a rate of half that of the inner shuttle 110, and in the opposite direction, the acceleration of the outer shuttles 108 and 112 is $a_i/2$. Accordingly, the accelerative force $F_o$ associated with the outer shuttles 112 is:

$$F_o=2m_s\cdot a(-a_i/2)$$

$$-m_s\cdot a_i$$

The total force $F_L$ on the lathe 102 at any time will therefore be:

$$F_L=F_i+F_o=m_s\cdot a_i-m_s\cdot a_i=0$$

If the second mass were other than twice that of the intermediate shuttle 110 (or "first mass" in this case), the rate of acceleration would have to be compensated accordingly. In any case, the acceleration of the second mass should correspond in phase and frequency with that of the first mass and should not induce a resulting moment about the intermediate shuttle. In other words, the forces associated with the outer shuttle 108 should be the same as those associated with the outer shuttle 112. It is expected that this will usually be accomplished by centrally disposing the intermediate shuttle 110 between the outer shuttles 108 and 112. It will however be appreciated that other arrangements might work such as compensating for not having the intermediate shuttle 110 centrally disposed by varying the respective masses and accelerations of the outer shuttles 108 and 112.

Figure 6:
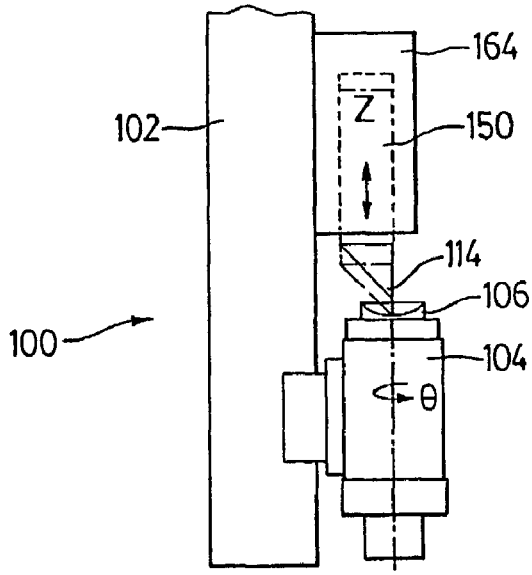
FIG. 6 is an end elevation corresponding to FIG. 5.
Figure 5:
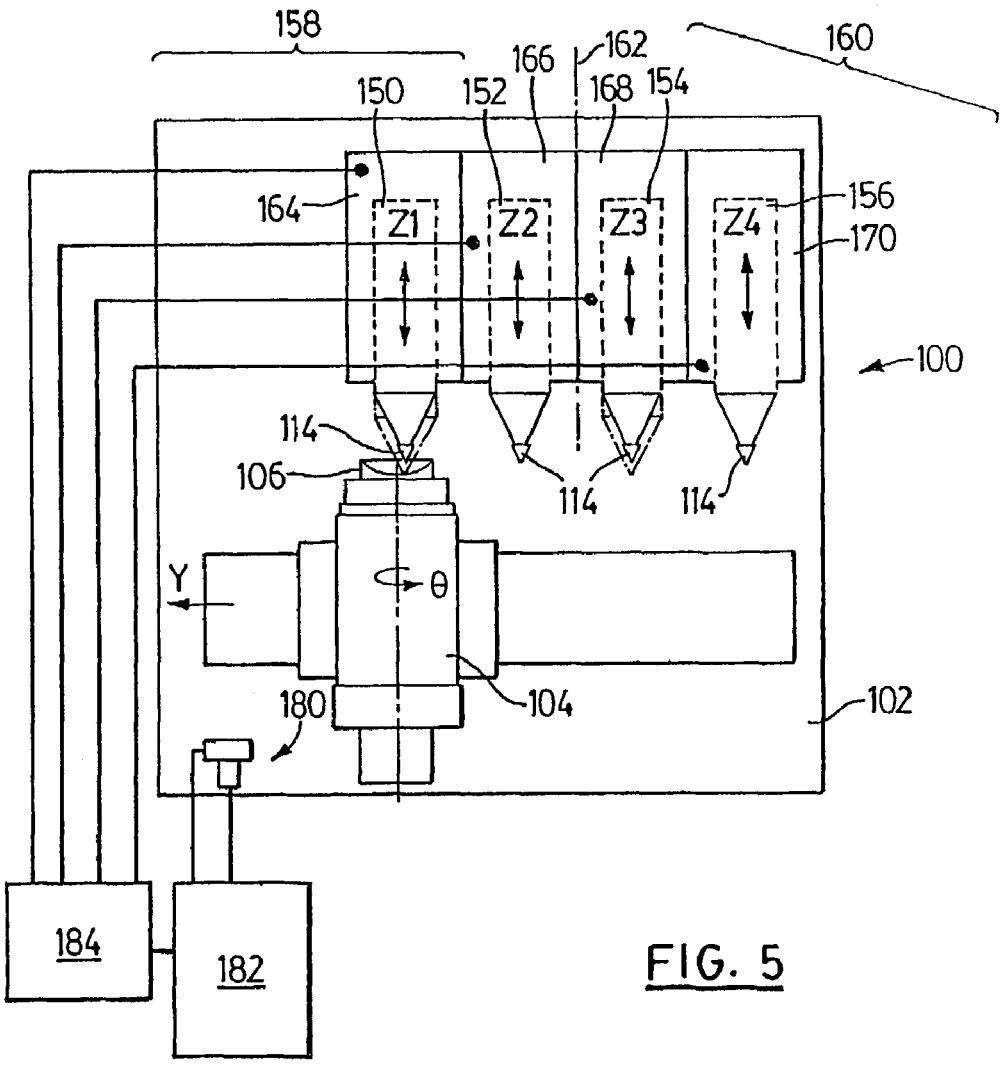
FIG. 5 is a front elevation illustrating a form shuttle lens cutting device according to the present invention.

FIGS. 5 and 6 illustrate another embodiment of the present invention according to which four shuttles 150, 152, 154 and 156 are provided. The shuttles 150, 152, 154 and 156 are arranged in a row and may be considered as comprising two pairs of shuttles 158 and 160 respectively on opposite sides of a central axis 162, with shuttles 150 and 152 comprising a first pair 158 and shuttles 154 and 156 comprising a second pair 160.

Respective actuators 164, 166, 168 and 170 are provided for the shuttles 150, 152, 154 and 156 to move the shuttles along respective parallel shuttle axes or "paths" Z1, Z2, Z3 and Z4, all of which while shown as also parallel to the central axis 162 and lens rotational axis θ need not be so. The respective shuttles 150 and 152 of the first pair 158 are arranged to move in opposite relative directions. Similarly, the respective shuttles 154 and 156 of the second pair 160 are arranged to move in opposite relative directions, but in phase with the first pair 158. In other words, the shuttle 150 would move together with (i.e. in the same direction as) one of the shuttles 154 and 156. Simultaneously, and in the opposite direction, the shuffle 152 would move together with the other of the shuttles 154 and 156.

In the four shuttle embodiment, the total mass of the shuttles moving in either direction is similar and accordingly the rate of acceleration would be similar. An advantage to the four shuttle embodiment is that the stroke length over which each of the shuttles 150, 152, 154 and 156 moves would be similar.

In the three shuttle embodiment, using the lens cutting tool 114 associated with the outer shuttles 108 and 112 may, in extreme cases, require a longer compensatory stroke than available from the intermediate shuttle 110. For example, if the actuator has a 30 mm stroke limit and a 20 mm stroke is required for the outer shuttles, the intermediate shuttle 110 wouldn't be able to deliver the requisite 40 mm stroke for full cancellation of reciprocally acting forces. It is expected however that this can be tolerated as stroke length diminishes toward the lens axis θ where tolerances are most critical. Accordingly, good force resolution should be possible in the more critical zone nearer the lens rotational axis θ.

Figure 8:
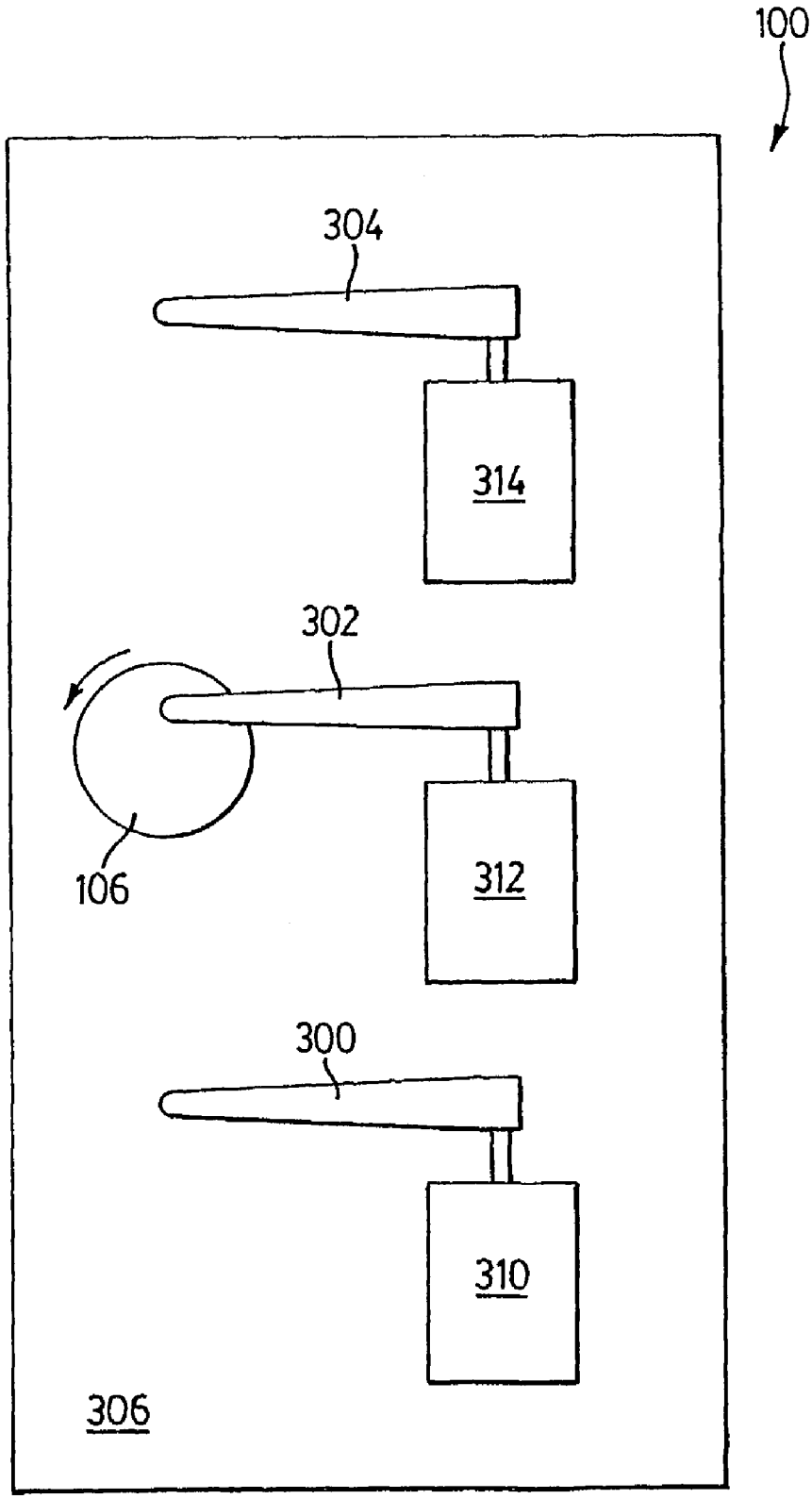
FIG. 8 is a top plan view of an alternate lathe configuration according to the present invention.
Figure 9:
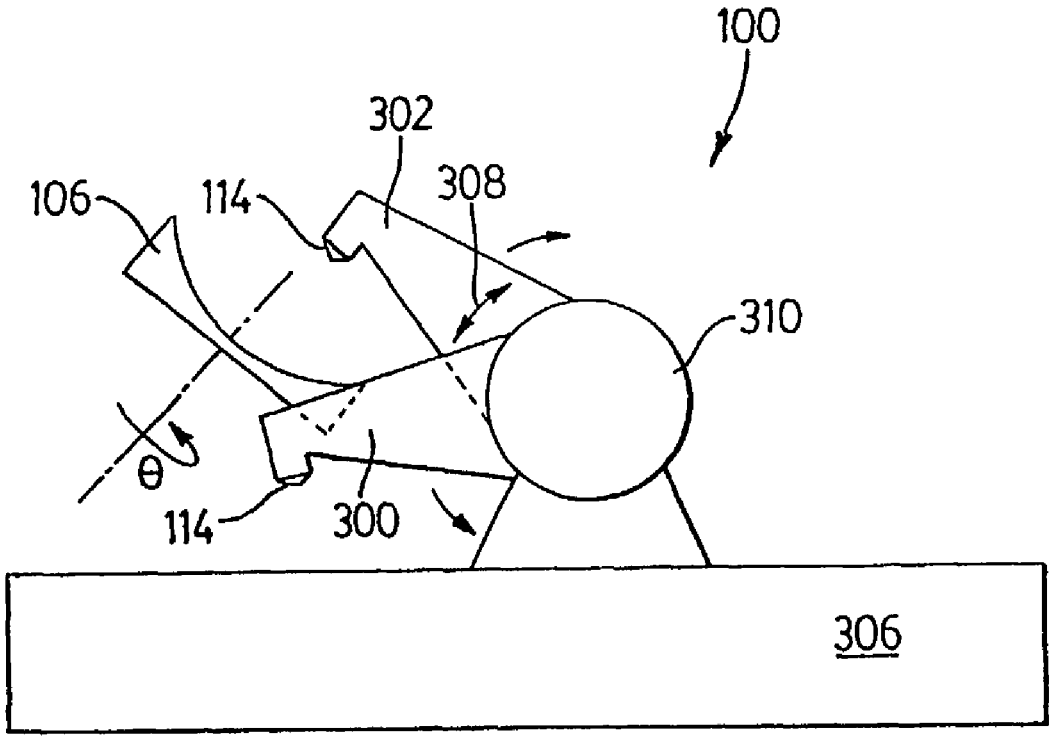
FIG. 9 is at front elevation corresponding to FIG. 8.

FIGS. 8 and 9 illustrate yet another embodiment of the present invention somewhat analogous to the embodiment described above with respect to FIGS. 3 and 4. In the FIGS. 8 and 9 embodiment, a lathe 100 has respective outer shuttles 300 and 304 and an inner shuttle 302 mounted to a base 306 for reciprocal movement along respective arcuate paths, as exemplified by arrow 308 in FIG. 9. The shuttles 300, 302 and 304 are moved by respective actuators 310, 312 and 314, which may be rotational servo-motors.

As with the FIGS. 3 and 4 embodiment, the actuators 310 and 314 are arranged to move the outer shuttles, 300 and 304 respectively, in a direction opposite that of the intermediate shuttle 302 and at a rate half that of the rate of movement of intermediate shuttle 302. The respective masses in each of the outer shuffles 300 and 304 would typically be about the same as that of the intermediate shuttle 302. Respective lens cutting tools 114 would also be of similar mass. Accordingly, forces imparted by movement of the intermediate shuttle 302 would be cancelled by similar forces imparted by movement of the outer shuttles 300 and 304.

The arrangement illustrated in FIGS. 8 and 9 could of course be expanded to more than three actuator/shuttle assemblies, for example, in a manner analogous to the four shuttle embodiment described above with reference to FIGS. 5 and 6.

Although the shuttle arrangement shown in FIGS. 8 and 9 features the shuttle actuators disposed along a common rotational axis parallel to a base, in certain cases the shuttle actuators may be disposed with respective rotational axes perpendicular (or possibly at some other angle) to the base. FIGS. 10, 11, 12 and 13 illustrate two embodiments of the latter type.

Figure 11:
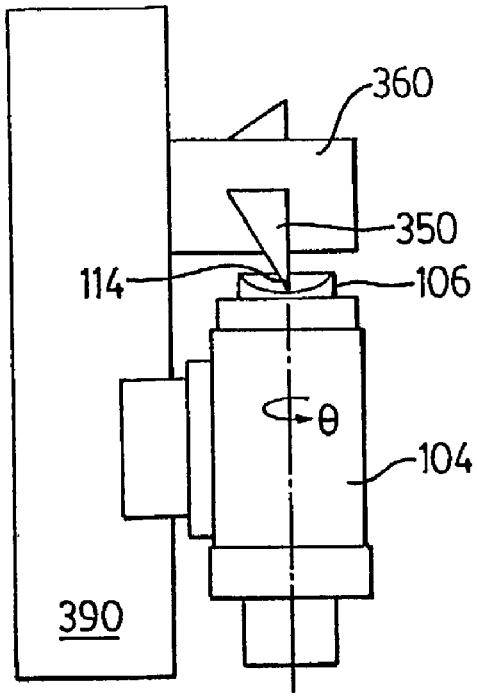
FIG. 11 is a front elevation corresponding to FIG. 10.
Figure 10:
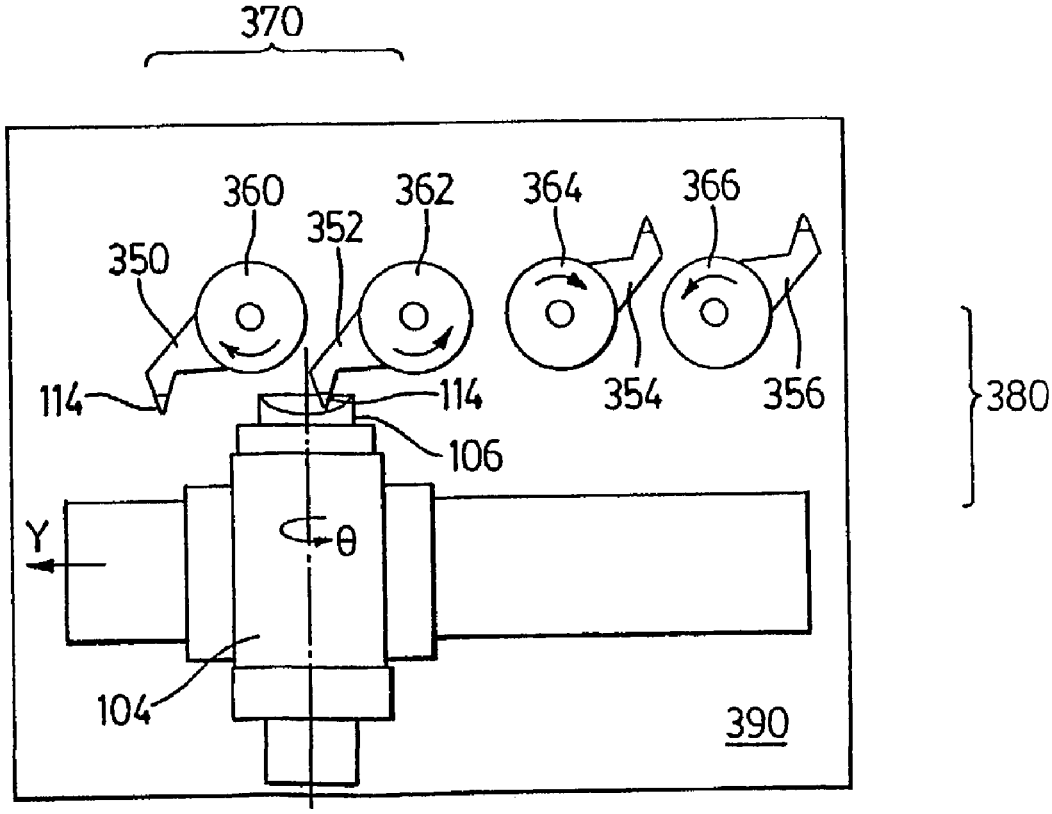
FIG. 10 is a top plan view of another alternate lathe configuration according to the present invention.

In the FIGS. 10 and 11 embodiment, four shuttles, 350, 352, 354 and 356 are provided. The shuttles 350, 352, 354 and 356 have respective actuators 360, 362, 364 and 366 which may be servo motors. Analogous to the FIGS. 5 and 6 embodiment, the shuttles 350 and 352 comprise a first pair 370 and the shuttles 354 and 356 comprise a second pair 380. The shuttles 350 and 352 of the first pair 370 are arranged to move in opposite relative directions parallel to a base 390. The shuttles 354 and 356 of the second pair 380 are also arranged to move in opposite relative directions parallel to the base 390, but in-phase with the first pair 370.

Figure 13:
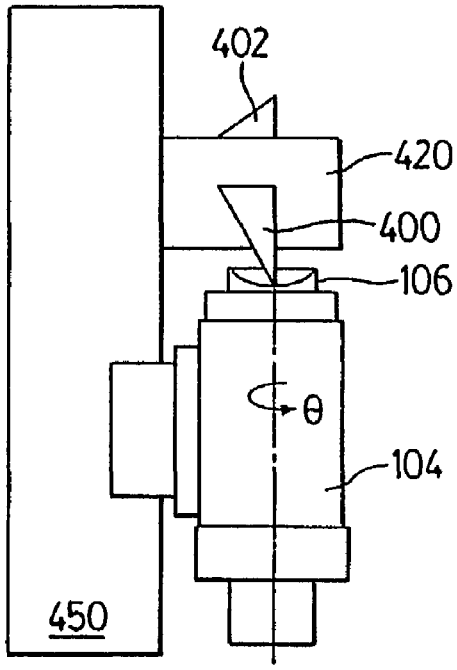
Figure 12:
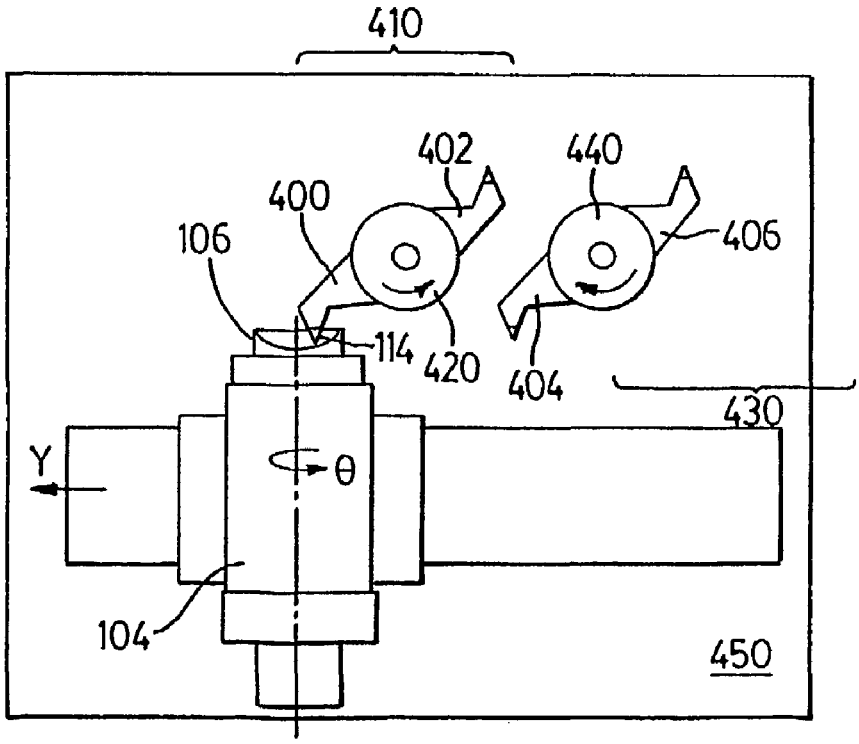
FIG. 12 is a top plan view of yet another alternate lathe configuration according to the present invention; and, FIG. 13 is a front elevation corresponding to FIG. 12.

FIGS. 12 and 13 illustrate a four shuttle embodiment similar to that illustrated in FIGS. 11 and 12, but having one actuator for each pair of shuttles. According to the FIGS. 12 and 13 embodiment, four shuttles, 400, 402, 404 and 406 are provided. The shuttles 400 and 402 comprise a first pair 410 and are radially disposed on opposite sides of an actuator 420 which may be a rotary servo motor. The shuttles 404 and 406 comprise a second pair 430 disposed on opposite sides of an actuator 440. The actuators 430 and 440 are mounted to a base 450 and rotate the shuttles 400, 402, 404 and 406 in arcuate paths parallel to the base 450.

The effect of mounting a pair of shuttles in a radially disposed configuration on opposite sides of a single actuator is much the same from a force cancellation perspective as having a pair of shuttles mounted to separate actuators moving in opposite relative directions.

Use of a rotary servo-motor generates both a rotational and a linear resultant force when the actuator/shuttle assemblies are not balanced. A linear resultant will be observed if the imbalance masses are 180 degrees out of phase. A rotational resultant will be observed if the imbalance masses are in phase. If the actuators are contra rotating the phase angle will constantly change giving both linear and rotational resultant forces.

In view of the more complex nature of the resultant forces arising in use of rotational actuators not having a common rotational axis, it would be quite complicated to eliminate resultant imbalance with a third actuator. Having four actuators or four shuttles mounted in two pairs to rotationally balance two actuators does however provide a substantially self-cancelling arrangement.

In order to compensate for minor variances resulting from such things as differences in combined shuttle and lens cutting tool mass or small amounts of asymmetricality in shuttle positioning, it may be desirable to monitor forces and make compensatory inputs to the actuators. FIG. 5 schematically illustrates one manner in which such a compensation may be effected.

A measuring device 180 connected to the lathe 100 which measures any resultant imbalance force on the lathe 100 which is associated with the reciprocal movement of the lens cutting tools 114 and generates an output signal indicative of the nature and amount of imbalance force. The measuring device may be any suitable device such as one or more load cells or accelerometers. The measuring device may be connected to any suitable part of the lathe 100 such as the base 102 or the actuators 164, 166, 168 and 170.

The output signal is sent to a processor 182 which determines the nature of the force and whether and how it can be nullified by varying movement of the actuators 164, 166, 168 and 170. Factors such as direction and phase of the imbalance force might be considered by the processor 182. The processor 182 generates and sends one or more output signals to one or more controllers 184 which communicates with and control the movement of the actuators 164, 166, 168 and 170.

The controller(s) 184 receive(s) the output signal(s) and vary the reciprocating movement caused by the actuators 164, 166, 168 and 170 in response to the output signal(s) to reduce the resultant imbalance force. The monitoring and compensation may be repeated at least periodically.

Depending on the degree of balance and any harmonic frequencies associated with the spindle rotation, it may prove more effective to do an "air pass" i.e. without cutting and while holding the spindle stationary. This could be repeated for each shuttle/actuator selected for cutting in turn as the dynamics may be slightly different for each shuttle/actuator combination selected for cutting at any given time. The variances might be stored by the processor to provide an initial setting and minimize set-up time.

The above description is intended in an illustrative rather than a restrictive sense. Variations to the embodiments described may be apparent to persons skilled in such structures without departing from the spirit and scope of the invention as defined by the claims set out below.

We claim:

1. A lens cutting lathe comprising:

a base;

a lens support mounted to said base for supporting said lens and spinning said lens about a lens rotational axis, said lens support being transversely moveable relative to said lens rotational axis;

a plurality of shuttles for mounting respective cutting tools mounted to said base in side by side arrangement far movement toward and away from said lens along respective generally parallel shuttle paths;

said plurality of shuttles being reciprocally movable by respectively actuators mounted to said base, said actuators being arranged to move some of said plurality of shuttles in a direction opposite to a remainder of said plurality of shuttles; and, said plurality of shuttles being of similar mass and disposed and moved in a manner to maintain a generally fixed center of mass whereby movement of said some of said shuttles in a given direction substantially cancels linear forces imposed on said base by movement or said remainder of said shuttles in the opposite direction.

2. A lens cutting lathe as claimed in claim 1 wherein:

said plurality of shuttles are further disposed and moved in a manner to also cancel rocking forces imposed on said base by said movement of said shuttles in said opposite directions.

3. A lens cutting lathe as claimed in claim 2 wherein;

said plurality of said shuttles consists of two outer shuttles and an intermediate shuttle therebetween;

said outer shuttles move together in opposite direction to said intermediate shuttle; and said outer shuttles move together at a rate of about one half that of said intermediate shuttle whereby the magnitude of accelerative forces generated by said outer shuttles is generally thee same as that generated by said intermediate shuttle.

4. A lens cutting lathe as claimed in claim 3 wherein:

said plurality of shuttle consists of a row of four of said shuttles arranged in two pair on either side of a central axis, said shuttles of each of said two pairs being arranged to move in opposite relative directions in phase with a corresponding shuttle of said opposite pair.

5. A lens cutting lathe as claimed in claim 3 wherein:

said shuttle paths are linear; and, each said actuator is a linear servo motor.

6. A lens cutting lathe as claimed in claim 3 wherein:

said shuttle paths are arcuate; and, each said actuator is a rotational servo-motor.

7. A lens cutting lathe as claimed in claim 4 wherein:

said shuttle paths are linear; and said actuator is a linear servo-motor.

8. A lens cutting lathe as claimed in claim 4 wherein:

said shuttle paths are arcuate; and, each said actuator is a rotational servo-motor.

9. A method of turning a non-rotationally symmetrical lens on a lens turning lathe having a lens support and at least three lens cutting tools, said method comprising the steps of:

(i) mounting a lens blank to a lens support assembly;

(ii) rotating said lens blank with said lens support assembly about a lens rotational axis;

(iii) pressing one of said at least three cutting tools against said lens blank;

(iv) moving said lens blank with said lens support assembly in a direction transverse to said lens rotational axis;

(v) reciprocally moving said one of said at least three lens cutting tools along a first tool path at a reciprocal frequency corresponding to the rotational frequency of said lens blank to produce said non-rotationally symmetrical surface; and, (vi) reciprocally moving remaining of said at least three lens cutting tools along respective tool paths generally parallel to said first tool path at said reciprocal frequency in a direction and at a rate which counters and substantially nullifies linear forces imposed on said lathe by said one tool in step (v) without imparting a rocking movement on said lathe.

10. A method according to claim 9 wherein:

said at least three lens cutting tools consist of a first and a last lens cutting tools with intermediate lens cutting tools disposed equidistantly therebetween and in line therewith; and, said first and last lens cutting tools are moved in unison contra to said intermediate lens cutting tool at a rate of about half that of said intermediate late lens cutting tool.

11. A method according to claim 10 wherein:

said lens is turned in at least two stages with a different of said lens cutting tools utilized in each stage.

12. A method according to claim 9 wherein:

first, second, third and fourth lens cutting tools are provided and arranged in line;

said first and second cutting tools are moved contra to each other at a similar rate;

said third and fourth cutting tools are moved contra to each other at a similar rate; and any rocking motion created by said first and second cutting tools is cancelled by an equal but opposite rocking motion created by said third and fourth cutting tools.

13. A method according to claim 10 including the further steps of:

(vii) measuring with a measuring device any resultant imbalance force on said lathe associated with said reciprocal movement of said lens cutting tools and generating an output signal indicative of the nature and the amount of said imbalance force, (viii) sending said output signal to a processor;

(ix) determining with said processor how said force may be nullified by varying movement of said actuators and generating at least one output signal to at least one controller which communicates with and controls movement of said actuators;

(x) receiving said output signal with said controller and varying said reciprocal movement cause by said actuators in response to said output signal to reduce said resultant imbalance force.

14. A method according to claim 13 including the further step of:

(xi) repeating steps (vii) through (x).

15. A method according to claim 11 including the further steps of:

(vii) measuring with a measuring device any resultant imbalance force on said lathe associated with said reciprocal movement of said lens cutting tools and generating an output signal indicative of the nature and the amount of said imbalance force, (viii) sending said output signal to a processor;

(ix) determining with said processor how said force may be nullified by varying movement of said actuators and generating at least one output signal to at least one controller which communicates with and controls movement of said actuators;

(x) receiving said output signal with said controller and varying said reciprocal movement cause by said actuators in response to said output signal to reduce said resultant imbalance force; and, (xi) repeating steps (vii) through (x).

16. A method according to claim 12 including the further steps of:

(vii) measuring with a measuring device any resultant imbalance force on said lathe associated with said reciprocal movement of said lens cutting tools and generating an output signal indicative of the nature and the amount of said imbalance force;

(vi) sending said output signal to a processor;

(ix) determining with said processor how said force may be nullified by varying movement of said actuators and generating at least one output signal to at least one controller which communicates with and controls movement of said actuators;

(x) receiving said output signal with said controller and varying said reciprocal movement cause by said actuators in response to said output signal to reduce said resultant imbalance force; and, (xi) repeating steps (vii) through (x).

17. A method according to claim 15 including the further steps of:

(vii) measuring with a measuring device any resultant imbalance force on said lathe associated with said reciprocal movement of said lens cutting tools and generating an output signal indicative of the nature and the amount of said imbalance force;

(viii) sending said output signal to a processor;

(ix) determining with said processor how said force may be nullified by varying movement of said actuators and generating at least one output signal to at least one controller which communicates with and controls movement of said actuators;

(x) receiving said output signal with said controller and varying said reciprocal movement cause by said actuators in response to said output signal to reduce said resultant imbalance force; and, (xi) repeating steps (vii) through (x).

18. A method according to claim 16 including the further steps of:

(vii) measuring with a measuring device any resultant imbalance force on said lathe associated with said reciprocal movement of said lens cutting tools and generating an output signal indicative of the nature and the amount of said imbalance force;

(viii) sending said output signal to a processor;

(ix) determining with said processor how said force may be nullified by varying movement of said actuators and generating at least one output signal to at least one controller which communicates with and controls movement of said actuators;

(x) receiving said output signal with said controller and varying said reciprocal movement cause by said actuators in response to said output signal to reduce said resultant imbalance force; and, (xi) repeating steps (vii) through (x).

19. A tool guidance assembly as claimed in claim 11 wherein:

said shuttle paths are generally parallel to said base.

* * * * *

UNITED STATES PATENT AND TRADEMARK OFFICE

CERTIFICATE OF CORRECTION

PATENT NO. : 7,036,408 B2
APPLICATION NO. : 10/332726
DATED : June 3, 2003
INVENTOR(S) : Savoie et al.

It is certified that error appears in the above-identified patent and that said Letters Patent is hereby corrected as shown below:

IN THE ABSTRACT

In the Abstract, at line 4, delete the phrase “three or more” and insert therefor --a plurality of--.

IN THE CLAIMS

Column 9, line 26, delete the word “far” and insert therefor --for--.

Column 9, line 29, delete the word “respectively” and insert therefor --respective--.

Column 9, line 52, delete the word “thee” and insert therefor --the--.

Column 11, line 33, delete the “(vi)” and insert therefor --(viii)--.

Signed and Sealed this

Twenty-third Day of January, 2007

JON W. DUDAS
*Director of the United States Patent and Trademark Office*

UNITED STATES PATENT AND TRADEMARK OFFICE

CERTIFICATE OF CORRECTION

PATENT NO. : 7,036,408 B2
APPLICATION NO. : 10/332726
DATED : May 2, 2006
INVENTOR(S) : Savoie et al.

It is certified that error appears in the above-identified patent and that said Letters Patent is hereby corrected as shown below:

IN THE ABSTRACT

In the Abstract, at line 4, delete the phrase "three or more" and insert therefor --a plurality of--.

IN THE CLAIMS

Column 9, line 26, delete the word "far" and insert therefor --for--.

Column 9, line 29, delete the word "respectively" and insert therefor --respective--.

Column 9, line 52, delete the word "thee" and insert therefor --the--.

Column 11, line 33, delete the "(vi)" and insert therefor --(viii)--.

This certificate supersedes Certificate of Correction issued January 23, 2007.

Signed and Sealed this

Twentieth Day of February, 2007

JON W. DUDAS
*Director of the United States Patent and Trademark Office*